US006649330B2

(12) United States Patent
Bringley et al.

(10) Patent No.: US 6,649,330 B2
(45) Date of Patent: Nov. 18, 2003

(54) SILVER HALIDE IMAGING ELEMENT CONTAINING SEQUESTERED SILVER IONS

(75) Inventors: Joseph F. Bringley, Rochester, NY (US); Kenneth J. Lushington, Rochester, NY (US); Tiecheng A. Qiao, Webster, NY (US); James S. Honan, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/033,517

(22) Filed: Dec. 28, 2001

(65) Prior Publication Data

US 2003/0157445 A1 Aug. 21, 2003

(51) Int. Cl.[7] ..... G03C 1/295; G03C 1/43; G03C 1/494; G03C 5/308; G03C 5/42

(52) U.S. Cl. ..... 430/414; 430/415; 430/416; 430/447; 430/550; 430/605; 430/617; 430/955

(58) Field of Search ..... 430/414, 415, 430/416, 605, 617, 955, 550, 447

(56) References Cited

U.S. PATENT DOCUMENTS

| | | | | |
|---|---|---|---|---|
| 3,647,439 A | * | 3/1972 | Bass | 430/416 |
| 4,942,119 A | | 7/1990 | Ozin et al. | 430/617 |
| 6,261,757 B1 | | 7/2001 | Irving et al. | 430/955 |

FOREIGN PATENT DOCUMENTS

EP 909 981 A1 4/1999

OTHER PUBLICATIONS

Abraham Clearfield and Soofin Cheng; "On The Mechanism Of Ion Exchange In Zirconium Phosphates–XXX"; *J. Inorg. Nucl. Chem.* vol. 42; pp. 1341–1345; 1980.

William R. Schleigh and William H. Faul; Research Disclosure 12924; Jan. 1975; "Incorporated Dye–Forming Blocked Developers"; pp. 27–30.

* cited by examiner

*Primary Examiner*—Richard L. Schilling
(74) *Attorney, Agent, or Firm*—Andrew J. Anderson

(57) ABSTRACT

In accordance with one embodiment of the invention, a photographic element is described comprising a support bearing one or more hydrophilic colloid layers including at least one photographic silver halide emulsion layer, wherein sequestered silver ions are incorporated into at least one hydrophilic colloid layer in the form of a silver ion containing material which sequesters silver ions prior to photographic processing and releases silver ions upon exposure to photographic processing solutions. Method for preparing and processing such photographic element are also described. In accordance with particular embodiments of the invention, the silver ion containing material comprises a silver ion-exchanged zeolite material or an intercalation composition comprising a layered host material having silver ions inserted as guest ions between the layers of the host material. The invention provides novel photographic materials and a method of incorporating silver ions directly into a photographic imaging element with improved stability and keeping response. The incorporation of silver ion containing materials into a photographic element in accordance with the invention enables increased upper scale density without excessive build-up of fog in the system.

25 Claims, No Drawings

SILVER HALIDE IMAGING ELEMENT CONTAINING SEQUESTERED SILVER IONS

FIELD OF THE INVENTION

The present invention relates to a method of incorporating sequestered silver ions into a hydrophilic colloid layer of a photographic element, and to photographic elements containing sequestered silver ions which may be released upon exposure to photographic processing solutions.

BACKGROUND OF THE INVENTION

The photographic system, in its most basic form, is comprised of silver halide (capable of detecting light and storing it as latent image) and developer molecules (capable of converting the latent image to a visible image). These two chemistries, however, are incompatible, as unexposed silver halide is thermodynamically unstable with respect to reduction in the presence of developer molecules. The consequence of this is that modern photography typically requires multiple steps: exposure and processing.

The effect of Ag ion upon the photographic system has long been a topic of study (see, e.g., "The Theory of the Photographic Process", T. H. James, ed.; $4^{th}$ ed., Chapter 13, 1977). Control of the Ag ion concentration is known to be important in the manufacture of silver halide emulsions, and in the production and processing of silver halide imaging elements. Most notably, the introduction of Ag ion into a silver halide imaging element may induce a phenomenon known as "solution physical development", in which silver ion in solution is adsorbed onto developing silver halide grains. The silver ion is then reduced by the developer, forming silver metal, and thereby can advantageously add to the overall density of the image. This process, however, is most often indiscriminate and leads to the build-up of fog in the system with no net gain in imaging efficiency. As a result of this, solution physical development process is generally avoided in most photographic systems, with the exception of some reversal processes. It would be desirable to provide photographic materials in which silver ions are effectively sequestered prior to photographic processing, so as to minimize build up of fog density, and which are released upon introduction of common photographic processing solutions and made available for enhancement of the photographic image.

Incorporation of active chemistry directly into film formulations, to either simplify or improve processing after exposure, has long been a goal in the photographic industry. Some photographically useful compounds are difficult to incorporate in a stable fashion into a light-sensitive material, however, or cause serious deterioration in the photographic capability if incorporated. These compounds, if incorporated directly into the photographic elements, typically need to be stabilized or rendered harmless by chemical modification prior to photographic processing. Methods of incorporating development and other active chemistries into photographic element formulations have been described in a number of patents and publications. Schleigh and Faul, in Research Disclosure 129 (1975) describe methods of appending color developers with "blocking" chemistry to prevent premature reaction. U.S. Pat. No. 6,261,757 to Irving et al. describes photographic articles in which developers and other photographic chemistries are ionically bound to the surface of ion-exchange resins.

U.S. Pat. No. 4,942,119 discloses materials comprising radiation sensitive silver compositions entrapped or encapsulated in the cages of a microporous sodalite lattice, prepared from synthetic sodium sodalites by a silver ion exchange process. There is no disclosure, however, of the use of such materials as a source of silver ions during processing of a photographic element comprising a silver halide emulsion.

EP 0 909 981 discloses silver halide photographic materials comprising zeolites loaded with a photographically useful group. Use of zeolites loaded with aqueous soluble silver salts and halide salts for the in situ preparation of ultramicrocrystalline silver halides for ripening onto coarser silver halide grains in a reaction vessel is also disclosed, but there is no disclosure of the use of such materials to incorporate sequestered silver ions which are to be released during processing of a photographic element.

Clearfield and Cheng (*J. Inorg. Nucl. Chem.*, 42, 1341 (1980)) have reported compositions and methods of preparing the following materials: $Zr(AgPO_4)_2.H_2O$, $ZrAg_{0.22}H_{1.78}(PO_4)_2$ and $ZrAg_{0.75}H_{1.25}(PO_4)_2$. There is no disclosure, however, of the use of such materials as a source of silver ions during processing of a photographic element comprising a silver halide emulsion.

SUMMARY OF THE INVENTION

In accordance with one embodiment of the invention, a photographic element is described comprising a support bearing one or more hydrophilic colloid layers including at least one photographic silver halide emulsion layer, wherein sequestered silver ions are incorporated into at least one hydrophilic colloid layer in the form of a silver ion containing material which sequesters silver ions prior to photographic processing and releases silver ions upon exposure to photographic processing solutions.

In accordance with another embodiment of the invention, a method for preparing a photographic element is described comprising forming a silver ion containing material which sequesters silver ions, adding the silver ion containing material to a hydrophilic colloid layer coating composition, and coating the hydrophilic colloid layer coating composition to form a layer of the photographic element, wherein the silver ion containing material which sequesters silver ions releases silver ions upon exposure of the photographic element to photographic processing solutions.

In accordance with a further embodiment of the invention, a method of processing a photographic material after exposure is described comprising contacting a photographic material according to the invention with a photographic processing solution having a greater concentration of cations other than silver ions relative to the silver ion containing material such that a cation concentration gradient is established, and releasing silver ions from the silver ion containing material by ion exchange with the silver ion containing material.

In accordance with particular embodiments of the invention, the silver ion containing material comprises a silver ion-exchanged zeolite material or an intercalation composition comprising a layered host material having silver ions inserted as guest ions between the layers of the host material. The invention provides novel photographic materials and a method of incorporating silver ions directly into a photographic imaging element with improved stability and keeping response. The incorporation of silver ion containing materials into a photographic element in accordance with the invention enables increased upper scale density without excessive build-up of fog in the system.

DETAILED DESCRIPTION OF THE INVENTION

In accordance with the invention, sequestered silver ions are incorporated into at least one hydrophilic colloid layer in the form of a silver ion containing material which sequesters silver ions prior to photographic processing and releases silver ions upon exposure to photographic processing solutions. In accordance with particular embodiments, the silver ion containing material comprises a silver ion-exchanged zeolite material or an intercalation composition comprising a layered host material having silver ions inserted as guest ions between the layers of the host material.

Intercalation is a process in which a layered material, referred to as the host, swells or opens to accommodate other molecules or ions, referred to as the guest:

$$\text{Host+guest} \rightarrow \text{Host(guest)}_x$$

Layered compounds capable of sequestering ions and molecules by intercalation have been described in a number of publications. The choice of host material is dependent upon the particular molecule to be intercalated, and a layered host material for use in accordance with the present invention, e.g., may be chosen which intercalates only cations. The choice of layered host materials for practice of the invention can be discerned from reviewing the wide body of literature available on intercalation chemistry and intercalation compounds. The following publications are included for reference on this matter: "*Intercalation Chemistry*", A. J. Jacobson and S. Whittingham, eds., Academic Press, NY 1982; "*Intercalated Layered Materials*", F. Levy, D. Riedel Press, Dordrecht, Holland (1979); W. T. Reichle, CHEMTECH, 16, 58 (1986); "*An Introduction to Clay Colloid Chemistry*", H. van Olphen, 2$^{nd}$ Ed., Krieger Pub. Co., Malabar, Fla. (1991).

Preferred layered host materials for use in the present invention include:

1) Layered metal hydrogen phosphate structures of the formula:

$$M(HPO_4)_2{\cdot}yH_2O;$$

where M is Zr, Ti, Sn, Ge or Hf or any combination thereof; and y is a rational number between 0 and 10.

2) Layered double hydroxides of the general formulas:

$$[M^{2+}{}_{1-x}M^{3+}{}_x(OH)_2]A^{n-}{}_{x/n}{\cdot}yH_2O$$

or $$[M^{4+}M^{3+}{}_2(OH)_6]A^{n-}{}_{x/n}{\cdot}yH_2O;$$

or hydroxy double salts of the general formula:

$$(M1^{2+}, M2^{2+})_5(OH)_8.\ (A^{n-})_{2/n}{\cdot}yH_2O;$$

where $M^{1+}$ is a monovalent metal selected from but not limited to Li, Na, K, Rb or Cs; and $M^{2+}$, $M1^{2+}$ or $M2^{2+}$ is a divalent metal selected from but not limited to Ca, Mg, Mn, Co, Ni, Cu, Zn, and Cd; and $M^{3+}$ is a trivalent metal selected from but not limited to Cr, Fe, Al, Ga, In, Mo; A is an anion chosen from $OH^-$, $NO_3^-$, $F^-$, $Cl^-$, $Br^-$, $I^-$, $ClO_4^{2-}$, $SO_4^{2-}$, $CO_3^{2-}$ or any inorganic or organic anion, especially carboxylates and sulfonates chosen such that the rule of charge neutrality is obeyed; n is an integer and x and y may be any rational number between 0 and 1, and between 0 and 10, respectively.

3) Layered siliceous materials such as natural or synthetic clay minerals exemplified by montmorillonite, bentonite, kaolin, magadiute, hectorite, vermiculite, smectites, beidellite, fluorohectorite, talc, muscovite and saponite or given by the general formula:

$$[M1,M2]_nZ_4O_{10}(OH)_2{\cdot}yH_2O._wM3;$$

where M1 is a metal selected from Al, Fe, Mn or Co and M2 is a metal selected from Mg, Fe, Ni, Zn or Li, Z is Al or Si; $H_2O$ is chemically absorbed water and M3 is a cation selected from, but not limited to K, Na, Li or Ca. n is a number from 0 to 4, y is a number from 0 to 10 and w is a number from 0 to 1.

Intercalation of layered materials creates complex materials consisting of guest molecules or ions captured within the host matrix. The layers of the host solid, typically only a few angstroms thick, exfoliate and swell in direct proportion to the size of the guest molecules or ions. The number of guest molecules or ions captured within the layers is determined by their size and the charge of the guest and the host. The process is reversible such that the guest molecules or ions can later be recovered from the complex system.

In accordance with a preferred embodiment of the invention, the silver ion containing composition host material comprises a layered metal hydrogen phosphate composition, and the resulting silver ion containing material comprises a silver ion exchangeable material of the formula:

$$M(H_{1-x}Ag_xPO_4)_2{\cdot}yH_2O;$$

where M is Zr, Ti, Sn, Ge or Hf or any combination thereof; x is a number from 0 to 1; and y is a rational number between 0 and 10. It is preferred though not necessary that the silver ion exchangeable material be insoluble in water and have an average particle size between 0.01 and 10.0 $\mu$m, and more preferably between 0.05 and 1.0 $\mu$m.

Zeolites are hydrated metal aluminosilicate compounds with well-defined (tetrahedral) crystalline structures. Because zeolite crystals, both natural and synthetic, have a porous structure with connected channels extending through them, they have been employed as molecular sieves for selectively adsorbing molecules on the basis of size, shape and polarity. Natural zeolites include, e.g., clinoptilite, chabazite and mordenite, but most types of zeolite known today have a synthetic origin. Reactants in zeolite synthesis have been described e.g. in "Hydrothermal Chemistry of Zeolites" by R. M. Barrer FRS, 1982, Academic Press, London New York. Differences in zeolite compositions are related with differing ratios of silica and aluminum, going from indefinite (or 1:0) to 1:1, as in a lattice structure it is impossible to have two trivalent aluminum ions in an adjacent position. Substitution of a tetravalent silicium ion by a trivalent aluminum ion brings about the presence of a less positive charge within the lattice structure of zeolite crystals. A deficiency of positive ions should therefore be compensated by the presence of "neutralizing" positive ions which are not incorporated in the lattice structure. Ion-exchanging properties are thus provided. Zeolites may have strongly differing properties as a consequence of their strongly differing balance between hydrophobic and hydrophilic properties of their crystal lattice. The presence of low amounts of aluminum ions provides hydrophobic water-repelling lattices, whereas higher amounts of trivalent aluminum ions provide water-attracting hydrophilic lattices. Less hydrophilic zeolite lattices therefore act as molecular sieves, adsorbing dedicated molecules in a selective way. Adsorbing properties further depend on the dimensions of the molecules and of the pores of the zeolite sieves. It has been established, e.g., that dimensions of zeolite pores are varying in the range from 0.4 to 4 nm.

Silver ions may be intercalated into a layered material structure or otherwise sequestered in an ion exchangeable silver ion containing material by various procedures. In a typical preparation the solid host compound having a particle size of less than 50 $\mu$m, and preferably less than 10 $\mu$m, and more preferably less than 1 μm is added to distilled water and a suspension is formed by rapid stirring. The aqueous medium may comprise plain water, or a hydrophilic colloid composition. The silver ion to be intercalated or ion exchanged is then added to the suspension. The mixture is allowed to stir for many hours or until the intercalation or ion exchange process is complete. Gentle heating may be applied to the mixture to accelerate the process if necessary. Non-aqueous solvents or mixtures may also be employed to carry out the reaction. The reaction progress may be monitored using powder X-ray diffraction and other analytical techniques. Powder X-ray diffraction provides direct information regarding the average distance between two adjacent layers of a layered host compound, commonly called the interlayer spacing. As intercalation proceeds the guest ions enter between the layers and thus the interlayer spacing typically increases to account for the guest ions. The interlayer spacing typically increases in direct proportion to the size of the guest. Other analytical techniques such as elemental analysis may be used to confirm the extent of reaction. Zeolites provided as fine powders may similarly be easily loaded with silver ion to form silver ion containing materials for use in accordance with the present invention by addition of the zeolite powder to an aqueous solution of a silver salt, e.g. sliver nitrate.

After the intercalation or silver ion loading step, the resulting silver ion containing composition may be recovered by filtration, centrifugation or other means and may be washed free of any un-incorporated ions and may then be stored until which time it is prepared for incorporation into a photographic element.

Compositions of silver ion containing materials prepared in accordance with the invention may be incorporated in photographic element hydrophilic colloid layer coating compositions. The composition may be added as a free solid or may be prepared by dispersing the solid into water or non-aqueous medium or into an aqueous hydrophilic colloid medium such as gelatin, or into a hydrophobic or hydrophilic polymer medium. A typical photographic light-sensitive material is based on hydrophilic colloid layers comprising silver halide emulsion compositions, though other types of materials are known using various other kinds of light-sensitive components. The silver ion containing compositions may be incorporated into a light sensitive emulsion layer or any other hydrophilic colloid layer which may be in association with a light sensitive emulsion layer. While improved results with respect to increased photographic speed, upper scale density, and/or contrast may be obtained over a wide coverage range of incorporated silver ions, in order to minimize adverse consequences with respect to increases in fog density it is preferred to utilize the silver ion containing materials at levels which provide less than or equal to about 5 wt % incorporated sequestered silver ions, more preferably less than or equal to about 4 wt % and most preferably less than or equal to about 3 wt %, relative to the weight of silver of the silver halide emulsions of the element. Preferred levels of incorporated sequestered silver ions are from about 0.01 to 5 wt %, more preferably from about 0.05 to 4 wt % and most preferably from about 0.1 to 3 wt %, relative to the weight of silver of the silver halide emulsion of the emulsion layer with which the silver ion containing material is associated.

Silver ion containing compositions prepared in accordance with the invention may be useful for single color elements (including black and white) or multicolor photographic elements. Silver halide multicolor elements typically contain a support and image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Various arrangements and constructions of silver halide color photographic materials may be employed for different types of imaging processes including, for example, diffusion transfer color photography and silver dye bleach color photography. Mixed grain photographic products and multilayer products are also known.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. If desired, a photographic element containing a dispersed photographically useful compound in accordance with the invention can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

Suitable materials for use in photographic emulsions and elements that can be used in conjunction with silver ion containing compositions prepared in accordance with the invention are further described in *Research Disclosure*, September 1994, Item 36544, available as described above, hereinafter referred to as *Research Disclosure I*. The contents of the *Research Disclosure I*, including the patents and publications referenced therein, are incorporated herein by reference, and the Sections hereafter referred to are Sections of the *Research Disclosure*, Item 36544. Silver halide emulsions which may be employed in photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX. It is also specifically contemplated that the materials and processes described in an article titled "Typical and Preferred Color Paper, Color Negative, and Color Reversal Photographic Elements and Processing," published in *Research Disclosure*, February 1995, Volume 370 may also be advantageously used with elements prepared in accordance with the invention. It is further specifically contemplated that the elements of the invention may further be used in combination with the various photographic compounds and systems such as described in U.S. Pat. No. 6,261,757 to Irving, et al., the disclosure of which is incorporated herein.

The silver halide emulsion grains to be used in the silver halide emulsion layer of the element of the invention may be of tabular or non-tabular shape, and may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. While any conventional combinations of chloride, bromide, and iodide ions may be employed in formation of silver halide emulsion grains for use in the elements of the present invention, in a preferred embodiment the element comprises a color paper print element and the silver halide emulsion layer comprises a high chloride (i.e., greater than 50 mole percent chloride, based on total silver, preferably greater than 70 mole percent chloride and more preferably greater than 90 mole percent chloride) silver halide emulsion. Use of the silver ion containing compositions described herein have been found to be particularly effective at increasing photographic speed, developability, and upper scale density without the build-up of fog in the system for color print elements comprising high chloride emulsions which are subjected to conventional color paper processing solutions.

The photographic elements of the present invention, as is typical, provide the silver halide in the form of an emulsion. The hydrophilic colloid in the hydrophilic colloid layers of the element of the present invention is a binder or protective colloid for the usual silver halide photographic light-sensitive materials. Such hydrophilic colloids also function as a vehicle for coating the emulsion as a layer of a photographic element. Useful hydrophilic colloid vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. The silver halide to be used in the invention may be advantageously subjected to chemical sensitization with noble metal (for example, gold) sensitizers, middle chalcogen (for example, sulfur) sensitizers, reduction sensitizers and others known in the art. These chemical sensitizers include active gelatin, sulfur, selenium, tellurium, gold, platinum, palladium, iridium, osmium, rhenium, phosphorous, or combinations thereof. Compounds and techniques useful for chemical sensitization of silver halide are known in the art and described in *Research Disclosure I* and the references cited therein. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

The silver halide may be spectrally sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

In accordance with the invention, silver ions which are sequestered in the silver ion containing materials described herein can advantageously be released from the host materials upon exposure to a processing solution having a greater local concentration of cations (other than silver ions) than the silver ion exchangeable material such that a cation concentration gradient is established to drive cation exchange and release of the sequestered silver ions. Alternatively, silver ions may be released from the silver ion containing materials upon a change in pH, or by other means such as heating or introduction of electrical current during processing. Developer processing solutions are typically both basic and contain a high concentration of cations and anions so as to facilitate release of the silver ions.

Photographic elements of the invention can be processed in any of a number of well-known photographic processes utilizing any of a number of well-known processing compositions, described, for example, in *Research Disclosure* referenced above, or in T. H. James, editor, *The Theory of the Photographic Process*, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are: 4-amino-N,N-diethylaniline hydrochloride, 4-amino-3-methyl-N,N-diethylaniline hydrochloride, 4-amino-3-methyl-N-ethyl-N-(b-(methanesulfonamido)ethylaniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

Photographic elements in accordance with this invention may also be processed in amplification processes that use developer/amplifier solutions described in U.S. Pat. No. 5,324,624, for example. When processed in this way, the low volume, thin tank processing system and apparatus described in U.S. Pat. No. 5,436,118 preferably is employed.

EXAMPLES

Preparation of $Zr(HPO_4)_2.H_2O$ Host Material

Into 500 ml of distilled water was dissolved 200.0 g of $ZrOCl_2.8H_2O$. This solution was then added dropwise to a hot solution (80–90° C.) of 42.5% phosphoric acid in 1500 ml of water with vigorous stirring. After the addition was complete the reaction mixture was stirred at 90° C. for 18 h. The solid product was then collected by filtration and carefully washed with 2.0 l of water and 300 ml of ethanol, yielding 177 g of a white solid. The purity of the product was confirmed by powder X-ray diffraction.

Preparation of Silver Ion Exchanged Materials

Silver ion containing compositions SC-1 to SC-3 used in the following examples were synthesized or otherwise obtained as indicated below.

Ag exchanged $Zr(HPO_4)_2.nH_2O$ compositions SC-1 and SC-2 were prepared by the following methods:

Method 1: Zirconium hydrogen phosphate, $Zr(HPO_4)_2.H_2O$ (10.00 g, 0.0332 moles) was suspended in 200 ml of distilled water. 2.5 M NaOH was added dropwise to this suspension until the pH was about 4. 200 ml of a 0.5 M $AgNO_3$ solution was then added to the suspension and the contents allowed to stir for 18 h. After this time the solid was separated in a centrifuge, washed with distilled water until no Ag ion could be detected in the eluent, and finally re-suspended to make a solution containing 3.8 w % gel and 7.5 w % solids. Elemental analysis showed the composition of the solid to be $Zr(Ag_{0.75}H_{0.25}PO_4)_2.H_2O$. This material is hereafter referred to as SC-1.

Method 2: 5.54 g of silver acetate was dissolved in 0.800 l of distilled water. Zirconium hydrogen phosphate, $Zr(HPO_4)_2.H_2O$ (5.00 g, 0.0166 moles) was then added to the solution and the contents allowed to stir for 18 h. After this time the solid was separated in a centrifuge, washed with distilled water until no Ag ion could be detected in the eluent, and finally re-suspended to make a solution containing 5.0 w % gel and 13.7 w % product. Elemental analysis showed the composition of the solid to be $Zr(Ag_{0.90}H_{0.10}PO_4)_2.H_2O$. This material is hereafter referred to as SC-2.

Silver-ion exchanged zeolite was also purchased from Aldrich Chemical Corp. This material is hereafter referred to as SC-3.

Example 1

The ability of a material to sequester, and later release, $Ag^+$ ions, was measured using the following general procedure. 100 g of a photographic silver halide emulsion melt is prepared which contains 3.85% by weight of a $AgBr_{0.97}I_{0.03}$ tabular grain emulsion and 5.6% by weight gelatin. The free silver ion and the bromide ion concentration of the emulsion melt is then monitored using a Ag/AgBr electrode. The silver ion containing materials SC-1 to SC-3 of the present invention described above were then added to the above emulsion in known quantities and the concentration of free $Ag^+$ ion and $Br^-$ ion measured. A mock photographic processing solution, which contains a known quantity of salts common in commercial photographic developer solutions such as NaBr and $NaNO_3$ , but which does not contain the reducing agent of the developer, is then added, and again the free $Ag^+$ ion and $Br^-$ ion concentration measured. The amount of $Br^-$ ion consumed in the reaction of the mock developer with the Ag-ion exchanger material is then equal to the quantity of silver released by the ion exchanger, as given by the reaction:

$$Ag^+ + Br^- \rightarrow AgBr(solid)$$

The data of these experiments is given in Table I below, the data are normalized so that the amount of silver added as the ion exchanger material initially in each case is, arbitrarily, 100.

TABLE I

| Material | Nominal Silver added (arb units) | $[Ag^+]$ before addition of "developer" | $[Ag^+]$ after addition of "developer" |
|---|---|---|---|
| SC-1 | 100 | less than 0.1 | 99.9 |
| SC-2 | 100 | less than 0.1 | 99.9 |
| SC-3 | 100 | less than 1.0 | 99.0 |

The data above show that the available free $Ag^+$ concentration is very small upon initial addition of the silver ion exchange material. Thus, the silver ion is effectively sequestered, or hidden, from the emulsion grains. The silver ion becomes available upon addition of the mock developer solution as the $Na^+$ cations are effectively exchanged for silver ion.

Example 2

Comparison example 2.1. A photographic element was prepared by coating a silver halide emulsion layer comprising 0.81 g/m$^2$ tabular grain $AgBr_{0.97}I_{0.03}$ emulsion (3.2 $\mu$m average diameter by 0.133 $\mu$m average thickness, spectrally red sensitized), 3.2 g/m$^2$ gelatin, 1.29 g/m$^2$ dye-forming coupler CC-1, and 1 w % surfactants onto a cellulose acetate film support. An overcoat was applied to the coating consisting of 2.69 g/m$^2$ gelatin, 1 w % surfactants and 1.75 wt % hardener.

CC-1

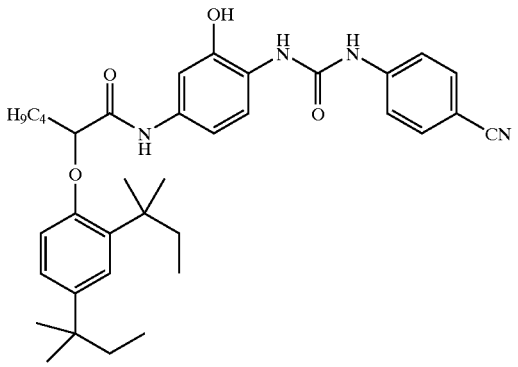

Invention Example 2.2. A photographic element was prepared identically as in comparison example 2.1, except that SC-1 at 0.001 g/m$^2$ was included in the coating. From elemental analysis, 0.001 g/m$^2$ SC-1 contains 0.00035 g/m$^2$ Ag ion.

Comparison Example 2.3. A photographic element was prepared identically as in comparison example 2.1, except that 0.00035 g/m$^2$ of Ag ion was added to the coating by addition of a 0.03 M $AgNO_3$ solution.

Invention Example 2.4. A photographic element was prepared identically as in comparison example 2.1, except that SC-1 at 0.01 g/m2 was included in the coating. From elemental analysis, 0.01 g/m$^2$ SC-1 contains 0.0035 g/m$^2$ Ag ion.

Comparison Example 2.5. A photographic element was prepared identically as in comparison example 2.1, except that 0.0035 g/m$^2$ of Ag ion was added to the coating by addition of a 0.03 M $AgNO_3$ solution.

Invention Example 2.6. A photographic element was prepared identically as in comparison example 2.1, except that 0.1 g/m$^2$ of SC-1 was included in the coating. From elemental analysis, 0.1 g/m$^2$ SC-1 contains 0.035 g/m$^2$ Ag ion.

Strips of each of the example coatings were tested for photographic response by exposing to a 365 nm line source through a 21-step step tablet. The strips were then developed for 3.15 minutes in C41 color negative developer and the density of each step read using an optical densitometer. The Dmin, relative photographic speed, and gamma (max contrast) results are given in Table II.

TABLE II

Photographic data for examples and comparison examples 2.1–2.6.

| Example | Ag ion added as SC-1 (g/m$^2$) | Ag ion added as $AgNO_3$ (g/m$^2$) | change in Dmin vs. Ex. 2.1 | Speed | max contrast |
|---|---|---|---|---|---|
| 2.1 (comparison) | none | none | N.A. | 100 | 1.35 |
| 2.2 (invention) | 0.00035 | none | 0.0 | 127 | 1.33 |
| 2.3 (comparison) | none | 0.00035 | +0.02 | 100 | 1.29 |

TABLE II-continued

Photographic data for examples and comparison examples 2.1–2.6.

| Example | Ag ion added as SC-1 (g/m$^2$) | Ag ion added as $AgNO_3$ (g/m$^2$) | change in Dmin vs. Ex. 2.1 | Speed | max contrast |
|---|---|---|---|---|---|
| 2.4 (invention) | 0.0035 | none | 0.0 | 150 | 1.49 |
| 2.5 (comparison) | none | 0.0035 | +0.03 | 126 | 1.46 |
| 2.6 (invention) | 0.035 | none | +0.07 | 223 | 1.20 |

As is observed from Table II, examples of the invention give greater speed and/or higher contrast with less fog (measured as Dmin) than the corresponding comparison examples in which Ag ion is added directly to the coating. These results demonstrate the ability of the host lattice to sequester and later release Ag ion to be made available to the photographic process.

Example 3

Comparison example 3.1. A photographic element was prepared according to the coating structure shown below. Photosensitive Layer 2 comprised a blue sensitized high chloride silver iodochloride emulsion. Yellow coupler YC-1 was delivered via an oil-in-water dispersion with coupler solvent CS-1 prepared by conventional means.

Coating Structure

| | | |
|---|---|---|
| Layer 3 | GEL SUPERCOAT | |
| | Gelatin | 1.077 g.m$^{-2}$ |
| | Hardener* | 0.112 g.m$^{-2}$ |
| | Alkanol XC ® | 0.026 g.m$^{-2}$ |
| | FT-248 | 0.010 g.m$^{-2}$ |
| Layer 2 | PHOTOSENSITIVE LAYER | |
| | Gelatin | 1.399 g.m$^{-2}$ |
| | Coupler YC-1 | 0.414 g.m$^{-2}$ |
| | CS-1 | 0.218 g.m$^{-2}$ |
| | St-1 | 0.080 g.m$^{-2}$ |
| | St-2 | 0.080 g.m$^{-2}$ |
| | St-3 | 0.080 g.m$^{-2}$ |
| | MHR | 0.0065 g.m$^{-2}$ |
| | PMT | 0.0013 g.m$^{-2}$ |
| | HQ-K | 0.00095 g.m$^{-2}$ |
| | Blue-sensitive emulsion | 0.213 g.m$^{-2}$ (as Ag) |
| Layer 1 | GEL PAD | |
| | Gelatin | 3.230 g.m$^{-2}$ |
| Support | Resin Coated Paper | |

*Hardener = bis(vinylsulphonylmethane)

HQ-K=2,5-dihydroxy-4-(1-methylheptadecyl)-benzenesulphonic acid (K salt)

MHR=2,5-dihydroxy-5-methyl-3-(4-morpholinyl)-2-cyclopenten-1-one

PMT=phenyl-mercaptotetrazole

YC-1

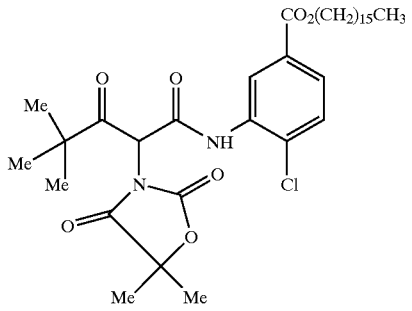

CS-1

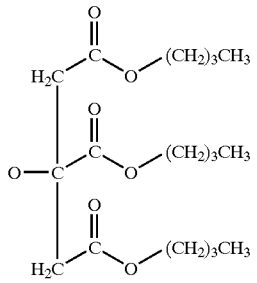

St-1

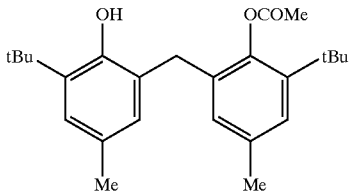

St-2

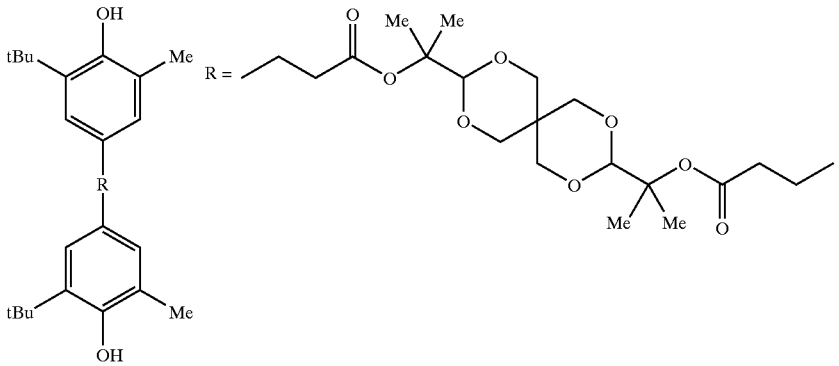

St-3

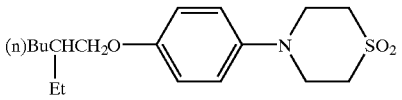

Invention Example 3.2. A photographic element was prepared identically as in comparison example 3.1, except that silver ion containing composition SC-2 was included in the photosensitive layer at 0.0054 g/m$^2$.

Invention Example 3.3. A photographic element was prepared identically as in comparison example 3.1, except that silver ion containing composition SC-2 was included in the photosensitive layer at 0.0108 g/m$^2$.

Invention Example 3.4. A photographic element was prepared identically as in comparison example 3.1, except that silver ion containing composition SC-2 was included in the photosensitive layer at 0.022 g/m$^2$.

Comparison Example 3.5. A photographic element was prepared identically as in comparison example 3.1, except that photosensitive Layer 2 comprised a red sensitized silver chloride emulsion and the following associated components.

Cyan coupler CC-2 was delivered via an oil-in-water dispersion prepared by conventional means.

| Layer 2 | PHOTOSENSITIVE LAYER | |
|---|---|---|
| | Gelatin | 1.399 $g \cdot m^{-2}$ |
| | Coupler CC-2 | 0.245 $g \cdot m^{-2}$ |
| | Tinuvin 328 ® | 0.337 $g \cdot m^{-2}$ |
| | CS-2 | 0.138 $g \cdot m^{-2}$ |
| | CS-3 | 0.414 $g \cdot m^{-2}$ |
| | Red-sensitive emulsion | 0.173 $g \cdot m^{-2}$ (as Ag) |

CC-2

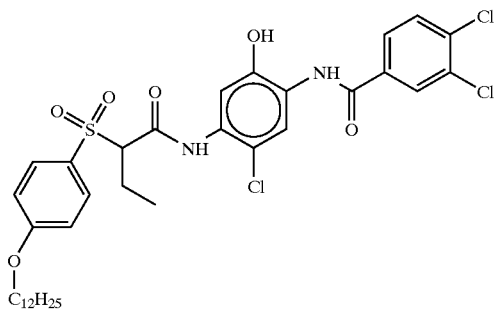

CS-2

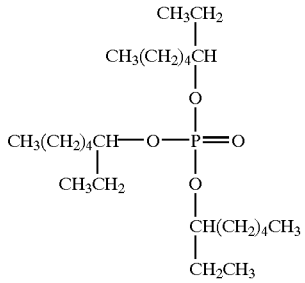

CS-3

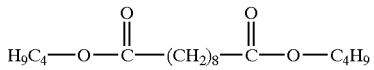

Invention Example 3.6. A photographic element was prepared identically as in comparison example 3.5, except that silver ion containing composition SC-2 was included in the photosensitive layer at 0.0054 $g/m^2$.

Invention Example 3.7. A photographic element was prepared identically as in comparison example 3.5, except that silver ion containing composition SC-2 was included in the photosensitive layer at 0.0108 $g/m^2$.

Invention Example 3.8. A photographic element was prepared identically as in comparison example 3.5, except that silver ion containing composition SC-2 was included in the photosensitive layer at 0.022 $g/m^2$.

Comparison Example 3.9. A photographic element was prepared identically as in comparison example 3.1, except that photosensitive Layer 2 comprised a green sensitized silver chloride emulsion and the following associated components. Magenta coupler MC-1 was delivered via an oil-in-water dispersion prepared by conventional means.

| Layer 2 | PHOTOSENSITIVE LAYER | |
|---|---|---|
| | Gelatin | 1.399 $g \cdot m^{-2}$ |
| | Coupler MC-1 | 0.183 $g \cdot m^{-2}$ |
| | St-3 | 0.059 $g \cdot m^{-2}$ |
| | St-4 | 0.153 $g \cdot m^{-2}$ |

-continued

| | | |
|---|---|---|
| | CS-4 | 0.218 $g \cdot m^{-2}$ |
| | CS-5 | 0.112 $g \cdot m^{-2}$ |
| | Green-sensitive emulsion | 0.104 $g \cdot m^{-2}$ (as Ag) |

MC-1

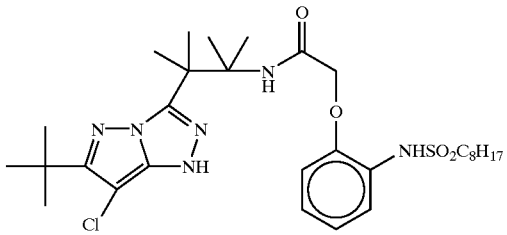

St-4

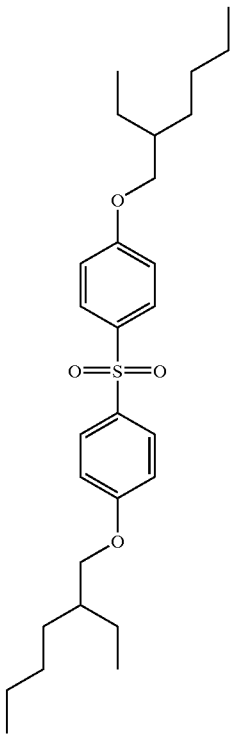

CS-4 $CH_3(CH_2)_7CH{=}CH(CH_2)_8{-}OH$

CS-5

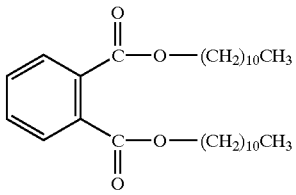

Invention Example 3.10. A photographic element was prepared identically as in comparison example 3.9, except that silver ion containing composition SC-2 was included in the photosensitive layer at 0.0054 $g/m^2$.

Invention Example 3.11. A photographic element was prepared identically as in comparison example 3.9, except that silver ion containing composition SC-2 was included in the photosensitive layer at 0.0108 $g/m^2$.

Invention Example 3.12. A photographic element was prepared identically as in comparison example 3.9, except that silver ion containing composition SC-2 was included in the photosensitive layer at 0.022 $g/m^2$.

Samples of each photographic element of examples 3.1 to 3.12 were given a neutral exposure and were processed according to the following scheme: Development was carried out in color paper developer formulation Developer-1 at 35° C. for varied times; Bleach/Fix was carried out in KODAK EKTACOLOR Prime Bleach/Fix at 35° C. for 45 seconds; Wash was carried out in water at 35° C. for 90 seconds.

Color paper developer formulation Developer-1.

| Developer Component | Concentration |
|---|---|
| Triethanolamine 100% | 5.5 mL |
| Versa TL-73 | 0.15 mL |
| Potassium Sulfite (45%) | 0.5 mL |
| BD-89 | 5.64 mL |
| Blankophor REU 170 | 0.82 g |
| Lithium Sulfate | 2.00 g |
| KODAK Anti-Calcium No. 5 | 0.60 mL |
| Potassium Chloride | 5.72 g |
| Potassium Bromide | 0.024 g |
| KODAK Color Developing Agent, CD-3 | 2.0 g |
| Potassium Carbonate | 25.0 g |
| Water to make (adjust pH to 10.10) | 1 L |

For each of the example coatings Dmin, relative Speed, and Shoulder Density (measured at an exposure 0.4 logE higher than the exposure necessary to provide a density of 0.8) were measured, and the results are presented in Table III. The developability for each of examples 3.1 to 3.7 was also measured and are indicated in Table IV, where developability (DEV) is defined as the ratio of the Status A maximum density with development arrested at 10 seconds relative to the Status A maximum density with 40 seconds development.

DEV=[Density at 10 s/Density at 40 s]×100%

TABLE III

| Example. | amount SC-2 added | Dmin | Speed | Shoulder Density |
|---|---|---|---|---|
| 3.1 (comparison) | none | 0.075 | 143 | 1.92 |
| 3.2 (invention) | 0.0051 | 0.079 | 149 | 1.96 |
| 3.3 (invention) | 0.0108 | 0.078 | 150 | 1.96 |
| 3.4 (invention) | 0.021 | 0.097 | 147 | 1.94 |
| 3.5 (comparison) | none | 0.107 | 132 | 2.1 |
| 3.6 (invention) | 0.0051 | 0.103 | 147 | 2.14 |
| 3.7 (invention) | 0.0108 | 0.120 | 151 | 2.11 |
| 3.8 (invention) | 0.021 | 0.32 | 157 | 1.94 |
| 3.9 (comparison) | none | 0.094 | 132 | 1.84 |
| 3.10 (invention) | 0.0051 | 0.113 | 135 | 1.81 |
| 3.11 (invention) | 0.0108 | 0.243 | 145 | 1.81 |
| 3.12 (invention) | 0.021 | 0.886 | 156 | 1.81 |

The improvement on photographic parameters and developability on the addition of $Zr(Ag_{0.90}H_{0.10}PO_4)_2.H_2O$ are given in Table IV.

TABLE IV

| Example. | amount CS-2 added | DEV |
|---|---|---|
| 3.1 (comparison) | none | 24 |
| 3.2 (invention) | 0.0051 | 34.5 |
| 3.3 (invention) | 0.0108 | 38.5 |
| 3.4 (invention) | 0.021 | 39 |
| 3.5 (comparison) | none | 64.5 |
| 3.6 (invention) | 0.0051 | 91 |
| 3.7 (invention) | 0.0108 | 96 |

The data show that the addition of silver ion containing composition SC-2 to the photographic coating generally improved upper scale densities, speed, and contrast, and developability of the two high silver laydown layers at shorter times of development, thus provides more robustness to the process.

The invention has been described in detail with particular reference to certain preferred embodiments thereof, but it will be understood that variations and modifications can be effected within the spirit and scope of the invention.

What is claimed is:

1. A photographic element comprising a support bearing one or more hydrophilic colloid layers including at least one photographic silver halide emulsion layer, wherein sequestered silver ions are incorporated into at least one hydrophilic colloid layer in the form of a silver ion containing material which sequesters silver ions prior to photographic processing and releases silver ions upon exposure to photographic processing solutions, wherein the silver ion containing material comprises a silver ion-exchanged zeolite material or an intercalation composition comprising a layered host material having silver ions inserted as guest ions between the layers of the host material.

2. A photographic element according to claim 1 wherein the silver ion containing material is contained in a hydrophilic colloid layer adjacent to a silver halide emulsion layer.

3. A photographic element according to claim 1 wherein the silver ion containing material comprises a silver ion-exchanged zeolite material.

4. A photographic element according to claim 1 wherein the silver ion containing material comprises an intercalation composition comprising a layered host material having silver ions inserted as guest ions between the layers of the host material.

5. A photographic element according to claim 4 wherein the layered host material comprises a layered metal hydrogen phosphate structure of the formula:

$$M(HPO_4)_2{\cdot}yH_2O;$$

where M is Zr, Ti, Sn, Ge or Hf or any combination thereof; and y is a rational number between 0 and 10.

6. A photographic element according to claim 5 wherein the layered host material comprises a layered double hydroxide structure of the formulas:

$$[M^{2+}{}_{1-x}M^{3+}{}_x(OH)_2]A^{n-}{}_{x/n}{\cdot}yH_2O \text{ or } [M^{1+}M^{3+}{}_2(OH)_6]A^{n-}{}_{x/n}{\cdot}yH_2O;$$

or hydroxy double salt of the general formula:

$$(M1^{2+}, M2^{2+})_5(OH)_8{\cdot}(A^{n-})_{2/n}{\cdot}yH_2O;$$

where $M^{1+}$ is a monovalent metal; $M^{2+}$, $M1^{2+}$ and $M2^{2+}$ are divalent metals; and $M^{3+}$ is a trivalent metal; A is any inorganic or organic anion, chosen such that the rule of charge neutrality is obeyed; n is an integer and x and y may be any rational number between 0 and 1, and between 0 and 10, respectively.

7. A photographic element according to claim 6 wherein where $M^{1+}$ is Li, Na, K, Rb or Cs; $M^{2+}$, $M1^{2+}$ and $M2^{2+}$ are Ca, Mg, Mn, Co, Ni, Cu, Zn, or Cd; $M^{3+}$ is Cr, Fe, Al, Ga, In, or Mo; and A is $OH^-$, $NO_3^-$, $F^-$, $Cl^-$, $Br^-$, $I^-$, $ClO_4^{2-}$, $SO_4^{2-}$, or $CO_3^{2-}$.

8. A photographic element according to claim 7 wherein A is a carboxylate or sulfonate anion.

9. A photographic element according to claim 4 wherein the layered host material comprises a layered siliceous material.

10. A photographic element according to claim 9 wherein the layered host material comprises a natural or synthetic clay minerals.

11. A photographic element according to claim 10 wherein the layered host material comprises montmorillonite, bentonite, kaolin, magadiite, hectorite, vermiculite, smectites, beidellite, fluorohectorite, talc, muscovite or saponite.

12. A photographic element according to claim 9 wherein the layered host material comprises a natural or synthetic clay minerals given by the formula:

$$[M1,M2]_nZ_4O_{10}(OH)_{2\cdot y}H_2O._wM3;$$

where M1 is a metal selected from Al, Fe, Mn or Co and M2 is a metal selected from Mg, Fe, Ni, Zn or Li; Z is Al or Si; $H_2O$ is chemically absorbed water; M3 is a cation; and n is a number from 0 to 4, y is a number from 0 to 10 and w is a number from 0 to 1.

13. A photographic element according to claim 12 wherein M3 is a cation selected from K, Na, Li or Ca.

14. A photographic element according to claim 1 wherein the silver ion containing material comprises a silver ion exchangeable material of the formula:

$$M(H_{1-x}Ag_xPO_4)_2{:}yH_2O;$$

where M is Zr, Ti, Sn, Ge or Hf or any combination thereof; x is a number from 0 to 1; and y is a rational number between 0 and 10.

15. A photographic element according to claim 14, wherein the silver ion exchangeable material has an average particle size between 0.01 and 10.0 $\mu$m.

16. A photographic element according to claim 14, wherein the silver ion exchangeable material has an average particle size between 0.05 and 1.0 $\mu$m.

17. A photographic element according to claim 1 wherein the silver ion containing material is contained in the silver halide emulsion layer.

18. A photographic element according to claim 17 wherein the sequestered silver ions are present in the element at a level from about 0.01 to 5 wt %, relative to the weight of silver of the silver halide emulsion of the emulsion layer.

19. A photographic element according to claim 17 wherein the sequestered silver ions are present in the element at a level from about 0.05 to 4 wt %, relative to the weight of silver of the silver halide emulsion of the emulsion layer.

20. A photographic element according to claim 17 wherein the sequestered silver ions are present in the element at a level from about 0.1 to 3 wt %, relative to the weight of silver of the silver halide emulsion of the emulsion layer.

21. A photographic element according to claim 1 wherein the element comprises a color paper print element and the silver halide emulsion layer comprises a silver halide emulsion comprising greater than 50 mole percent chloride, based on total silver.

22. A photographic element according to claim 21, wherein the silver halide emulsion comprises greater than 90 mole percent chloride, based on total silver.

23. A method for preparing a photographic element, comprising forming a silver ion containing material which sequesters silver ions, which silver ion containing material comprises a silver ion-exchanged zeolite material or an intercalation composition comprising a layered host material having silver ions inserted as guest ions between the layers of the host material, adding the silver ion containing material to a hydrophilic colloid layer coating composition, and coating the hydrophilic colloid layer coating composition to form a layer of the photographic element, wherein the silver ion containing material which sequesters silver ions releases silver ions upon exposure of the photographic element to photographic processing solutions.

24. A method of processing a photographic material after exposure, wherein the photographic material comprises a support bearing one or more hydrophilic colloid layers including at least one photographic silver halide emulsion layer, wherein sequestered silver ions are incorporated into at least one hydrophilic colloid layer in the form of a silver ion containing material which sequesters silver ions prior to photographic processing and releases silver ions upon exposure to photographic processing solutions, the method comprising contacting the photographic material with a photographic processing solution having a greater concentration of cations other than silver ions relative to the silver ion containing material such that a cation concentration gradient is established, and releasing silver ions from the silver ion containing material by ion exchange with the silver ion containing material.

25. A method according to claim 24, wherein the silver ion containing material comprises a silver ion-exchanged zeolite material or an intercalation composition comprising a layered host material having silver ions inserted as guest ions between the layers of the host material.

* * * * *